US011848520B2

(12) United States Patent
Matsumoto et al.

(10) Patent No.: US 11,848,520 B2
(45) Date of Patent: Dec. 19, 2023

(54) ELECTRICAL CONNECTION STRUCTURE

(71) Applicant: J.S.T. Mfg. Co., Ltd., Tokyo (JP)

(72) Inventors: Hiroyuki Matsumoto, Yokohama (JP); Yoshinori Hayakawa, Yokohama (JP); Kazuya Izawa, Yokohama (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 154 days.

(21) Appl. No.: 17/513,845

(22) Filed: Oct. 28, 2021

(65) Prior Publication Data

US 2022/0166167 A1 May 26, 2022

(30) Foreign Application Priority Data

Nov. 20, 2020 (JP) ..... 2020-193576

(51) Int. Cl.
*H01R 13/641* (2006.01)
*H01R 13/502* (2006.01)
(Continued)

(52) U.S. Cl.
CPC ..... *H01R 13/641* (2013.01); *H01R 13/502* (2013.01); *H01R 13/629* (2013.01); *H01R 13/642* (2013.01)

(58) Field of Classification Search
CPC .. H01R 13/641; H01R 13/502; H01R 13/629; H01R 13/642
(Continued)

(56) References Cited

U.S. PATENT DOCUMENTS 5,470,251 A * 11/1995 Sano ..... H01R 13/641 439/489
5,562,486 A * 10/1996 Saijo ..... H01R 13/703 439/489
(Continued)

FOREIGN PATENT DOCUMENTS

CN 107534252 A 1/2018
JP H07-42057 U 7/1995
(Continued)

OTHER PUBLICATIONS

Office Action of corresponding Chinese Patent Application No. 202111225174.4 dated May 24, 2023 (7 sheets, 3 sheets partial translation, 10 sheets total).
(Continued)

*Primary Examiner* — Alexander Gilman
(74) *Attorney, Agent, or Firm* — Kratz, Quintos & Hanson, LLP

(57) ABSTRACT

An electrical connection structure comprises a base member, a connector, and a mating connector. The electrical connection structure comprises a half-fitting detecting mechanism including a half-fitting detecting portion in the connector and a short-circuiting member in the mating connector. The half-fitting detecting portion includes a conductive member and an inspecting member. The half-fitting detecting portion allows a half-fitting state to be detected by the short-circuiting member being in non-contact with the inspecting member when in the half-fitting state. The inspecting member short-circuits with the conductive member via the short-circuiting member by the mating engaging portion of the short-circuiting member being engaged with the engaging portion of the connector and being in contact with a contact part of the inspecting member and the short-circuiting
(Continued)

member being in contact with the conductive member when in a normal fitting state.

5 Claims, 8 Drawing Sheets

(51) Int. Cl.
*H01R 13/629* (2006.01)
*H01R 13/642* (2006.01)

(58) Field of Classification Search
USPC ..... 439/489
See application file for complete search history.

(56) References Cited

U.S. PATENT DOCUMENTS 5,913,703 A * 6/1999 Suzuki ..... H01R 13/641 439/701
7,798,832 B2 * 9/2010 Qin ..... H01R 13/7035 439/188
8,696,369 B2 * 4/2014 Mattson ..... H01R 29/00 439/418
8,715,012 B2 * 5/2014 Taylor ..... G02B 6/42 439/676
9,190,781 B2 * 11/2015 Chang ..... H01R 13/6683
10,290,971 B2 * 5/2019 Oishi ..... H01R 13/7032
11,417,990 B2 * 8/2022 Matsuura ..... H01R 13/64
11,652,307 B2 * 5/2023 Yue ..... H01R 13/6582 439/676
2018/0115110 A1 4/2018 Fujii
2018/0241148 A1 * 8/2018 Tang ..... H01R 13/6581
2020/0335914 A1 * 10/2020 Hsu ..... H01R 12/716

FOREIGN PATENT DOCUMENTS

JP H09-147988 A 6/1997
JP 2939851 B2 8/1999
JP 2006-179254 A 7/2006
JP 3884093 B2 2/2007
JP 4717733 B2 7/2011
JP 2019-040746 A 3/2019
WO 2008/150523 A2 12/2008

OTHER PUBLICATIONS

Extended European Search Report for European Patent Application No. 21206407.5 dated Apr. 11, 2022 (14 sheets).

* cited by examiner

ELECTRICAL CONNECTION STRUCTURE

TECHNICAL FIELD

The disclosure relates to an electrical connection structure.

BACKGROUND OF THE INVENTION

In an electrical connection structure using connectors, generally, a connector and a mating connector are electrically connected to each other by the connector and the mating connector being fitted thereto. A state in which the connector and the mating connector are not fitted to each other in a normal fitting state, such as connector and the mating connector being fitted to each other in a fitting length being slightly shorter than a regular fitting length, for example, is called a half-fitting state. In the half-fitting state, the connector and the mating connector receive an undesirable influence such as a reduction in the electrical connection reliability. However, the half-fitting state can be indistinguishable from the normal fitting state in appearance. Thus, a connector that can detect the half-fitting state is called for.

Japanese Patent Application Publication No. 2019-040746 discloses an electrical connection structure comprising a board; a connector mounted to the board; and a mating connector to be fitted to the connector, wherein the electrical connection structure comprises a half-fitting detecting mechanism to electrically detect whether the connector and the mating connector are fitted to each other in a regular fitting position. In the electrical connection structure of Japanese Patent Application Publication No. 2019-040746, the half-fitting detecting mechanism is made up of a half-fitting detecting portion provided in the connector and an electrically conductive short-circuiting member provided in the mating connector. The half-fitting detecting portion is made up of a pair of electrically conductive inspecting members being arranged at a distance. The pair of inspecting members is configured to be in an insulating state when the mating connector is not arranged in the regular fitting position in the connector and to be in a state of being short-circuited via the inspecting member of the mating connector when the mating connector is arranged in the regular fitting position. According to the electrical connection structure of Japanese Patent Application Publication No. 2019-040746, whether the mating connector is not fitted to the connector in the half-fitting state can be electrically detected in accordance with the presence/absence of short circuiting of the pair of inspecting members.

SUMMARY OF THE INVENTION

In an electrical connection structure using connectors, generally, a connector and a mating connector being engaged with each other in a normal fitting state causes the connector and the mating connector being separated from each other to be suppressed and an electrical connection to be held. According to the electrical connection structure of Japanese Patent Application Publication No. 2019-040746, a mating connector is provided with a mating engaging portion being separate from a short-circuiting member and to be engaged with a connector. Thus, the short-circuiting member being deformed in a direction away from a board with respect to a regular position due to an initial failure, for example, can produce an erroneous detection result that the short-circuiting member and a pair of inspecting members are short circuited and the mating connector is in a normal fitting state despite it being in a half-fitting state in which the mating engaging portion is not engaged with the connector.

Then, in view of such problems as described above, an object of the disclosure is to provide an electrical connection structure that can reliably detect a half-fitting state.

An electrical connection structure according to one embodiment of the disclosure comprises: a base member; a connector being mounted to the base member to be electrically connected thereto; and a mating connector to be fitted/separated in a fitting/separating direction with respect to the connector and to be electrically connected to the connector by being fitted thereto, wherein the electrical connection structure comprises a half-fitting detecting mechanism to detect whether the mating connector is fitted in a normal fitting state; the half-fitting detecting mechanism includes: a half-fitting detecting portion being provided in the connector; and a short-circuiting member being electrically conductive and provided in the mating connector, wherein the half-fitting detecting portion includes: an electrically conductive member being electrically connected to the base member to be in contact with the short-circuiting member of the mating connector to electrically connect the short-circuiting member and the base member; and an inspecting member being electrically conductive, having a contact part to be in contact with the short-circuiting member, and being provided in a non-contact state with respect to the electrically conductive member; wherein the half-fitting detecting portion allows a half-fitting state to be detected by the short-circuiting member being in non-contact with the inspecting member when the mating connector is fitted to the connector in the half-fitting state, wherein the connector has an engaging portion to engage with a mating engaging portion of the short-circuiting member to suppress separating of the mating connector, and wherein the inspecting member short-circuits with the electrically conductive member via the short-circuiting member by the mating engaging portion being engaged with the engaging portion and being in contact with the contact part and the short-circuiting member being in contact with the electrically conductive member when the mating connector is fitted to the connector in the normal fitting state.

In one embodiment, the electrically conductive member can make up at least a part of a fitting portion to be fitted to the mating connector.

In one embodiment, a contact portion of the contact part and the mating engaging portion and a contact portion of the electrically conductive member and the short-circuiting member can be lined up at a distance along the fitting/separating direction when they are in the normal fitting state.

In one embodiment, the inspecting member can extend along the fitting/separating direction, and an end on the fitting direction side of the inspecting member can be electrically connected to the base member.

In one embodiment, the contact part can be provided at an edge on the separating direction side of the inspecting member, wherein the electrically conductive member has: a through hole being provided so as to be positioned on an inner surface of a housing of the connector and being provided in correspondence with the contact part; and an abutting portion to abut on the short-circuiting member, on at least one of the fitting direction side and the separating direction side with respect to the through hole, wherein the short-circuiting member is a cantilevered elastic member extending in the fitting/separating direction, wherein the short-circuiting member has a short-circuiting portion on at least one of the fitting direction side and the separating direction side with respect to the mating engaging portion, which short-circuiting portion is to abut on the abutting portion in the normal fitting state, wherein the mating engaging portion is in sliding contact with the electrically conductive member on the separating direction side with respect to the through hole by the short-circuiting member being pressed against the electrically conductive member to be elastically deformed when the mating connector moves in the fitting direction to be fitted to the connector, and the inspecting member short-circuits with the electrically conductive member via the short-circuiting member by the mating engaging portion being elastically restored so as to be positioned in the through hole to be in contact with the contact part and the short-circuiting portion being in contact with the abutting portion when the mating connector is fitted to the connector in the normal fitting state.

The electrical connection structure according to one embodiment of the disclosure makes it possible to provide an electrical connection structure that can reliably detect a half-fitting state.

DETAILED DESCRIPTION

Figure 2A:
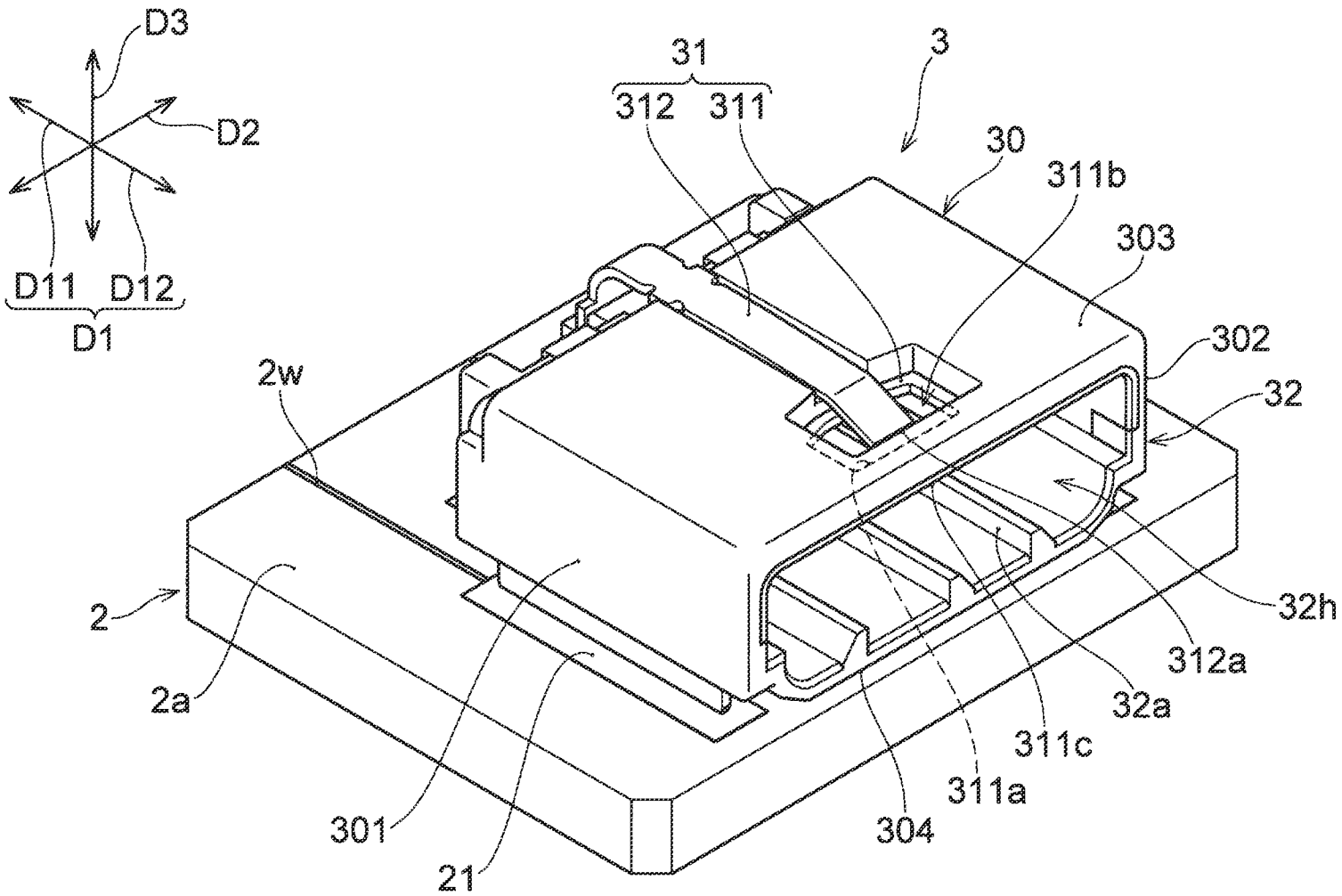
FIG. 2A is a perspective view showing one example of the connector of the electrical connection structure according to one embodiment of the disclosure.
Figure 2B:
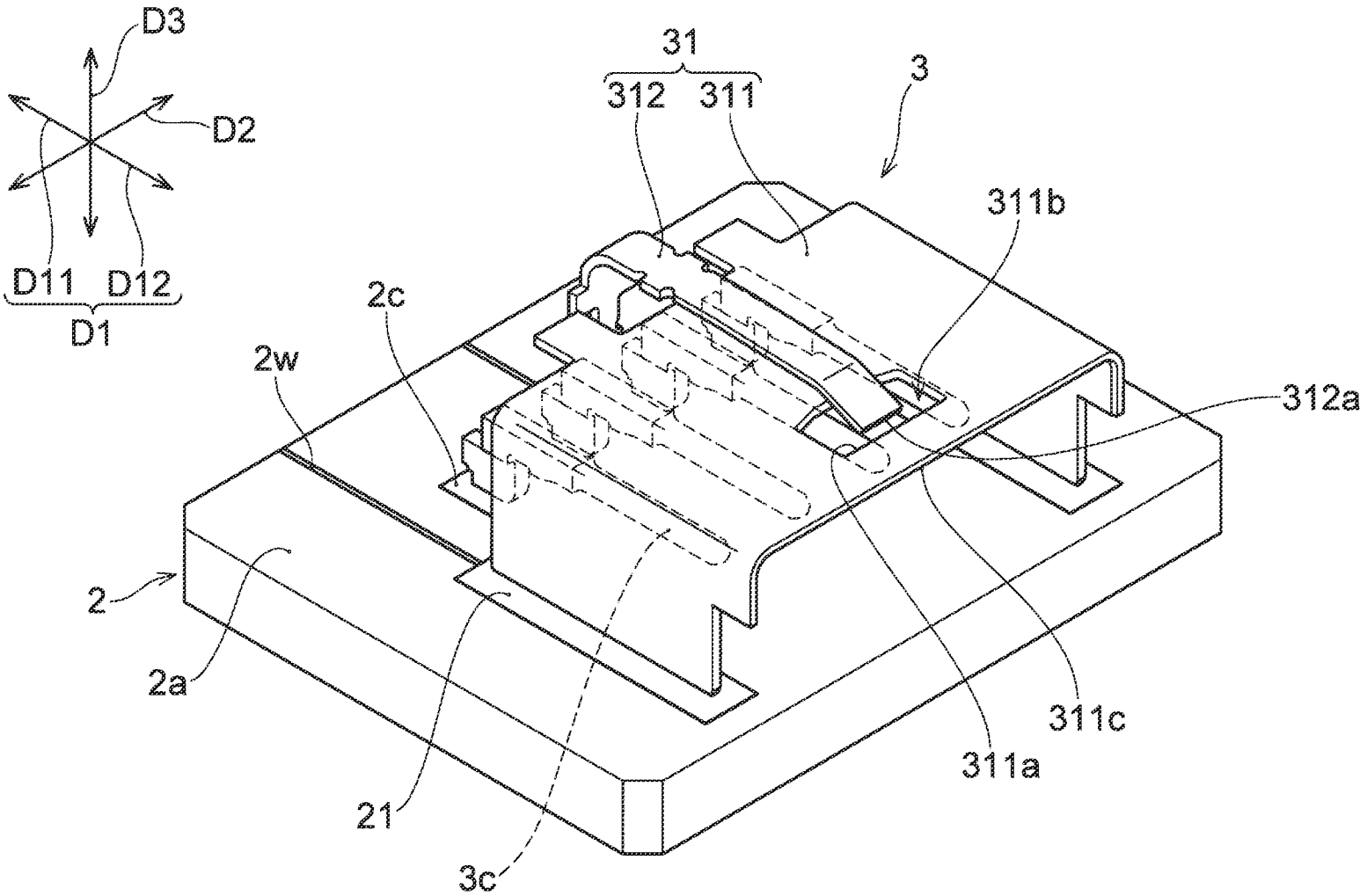
FIG. 2B is a perspective view in which the housing of the connector is removed from FIG. 2A.
Figure 3:
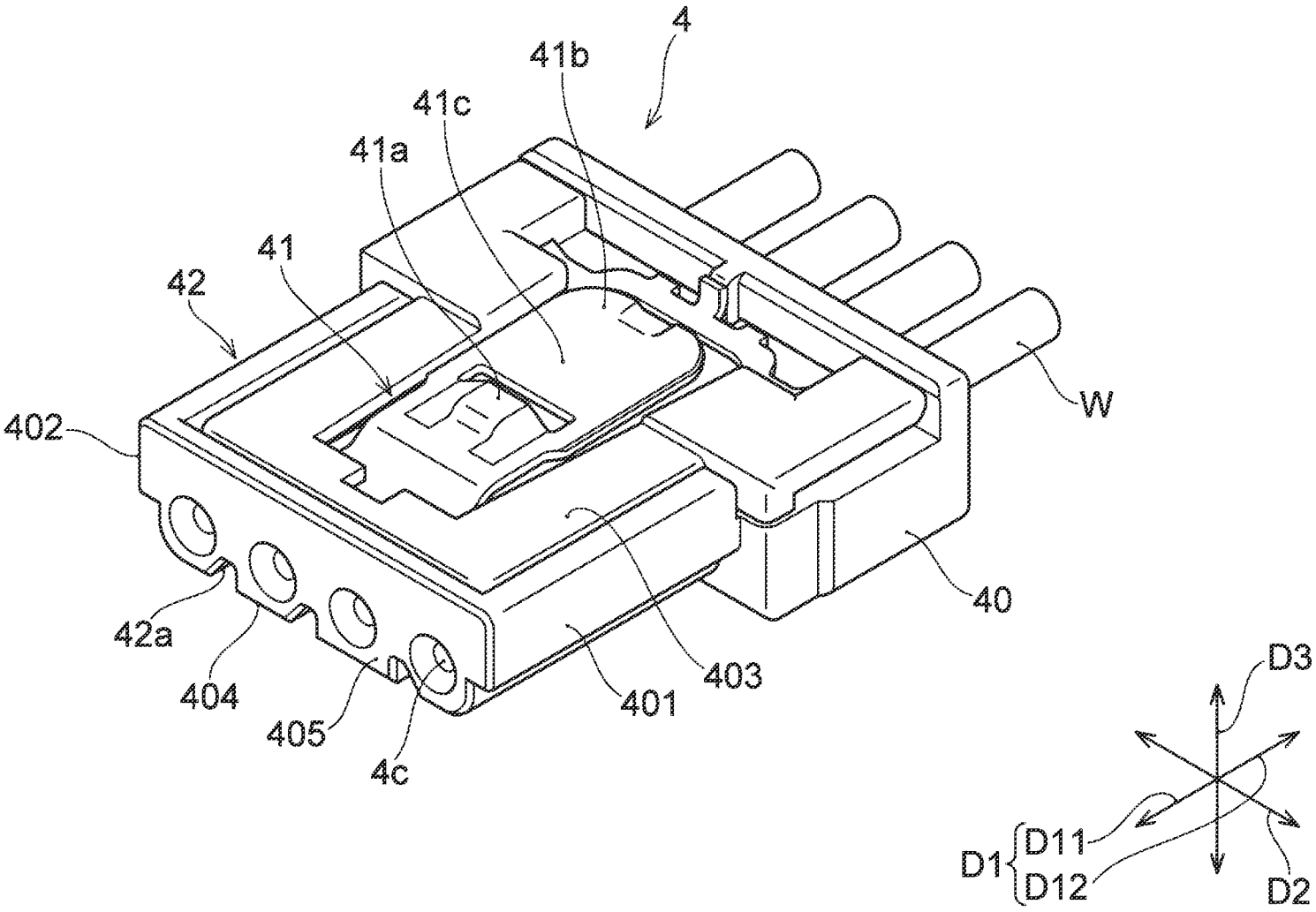
FIG. 3 is a perspective view showing one example of the mating connector of the electrical connection structure according to one embodiment of the disclosure.

With reference to FIGS. 1 to 3, an electrical connection structure according to one embodiment of the disclosure will be described. The embodiment shown below is merely one example, so that the electrical connection structure according to the disclosure is not limited to the embodiment below. In the specification, the expression "vertical to A" and that being similar thereto are to refer not only to a direction being completely vertical to A, but are to refer to include that they are substantially vertical to A. Moreover, in the specification, the expression "parallel to B" and that being similar thereto are to refer not only to a direction being completely parallel to B, but are to refer to include that they are substantially parallel to B. Furthermore, in the specification, the expression "C shape" and that being similar thereto are to refer not only to a complete C shape, but are to refer to include a shape that may remind the C shape in appearance (a substantially C shape), such as a shape in which a corner portion of the C shape is chamfered.

(Electrical Connection Structure According to the Embodiment)

Figure 1A:
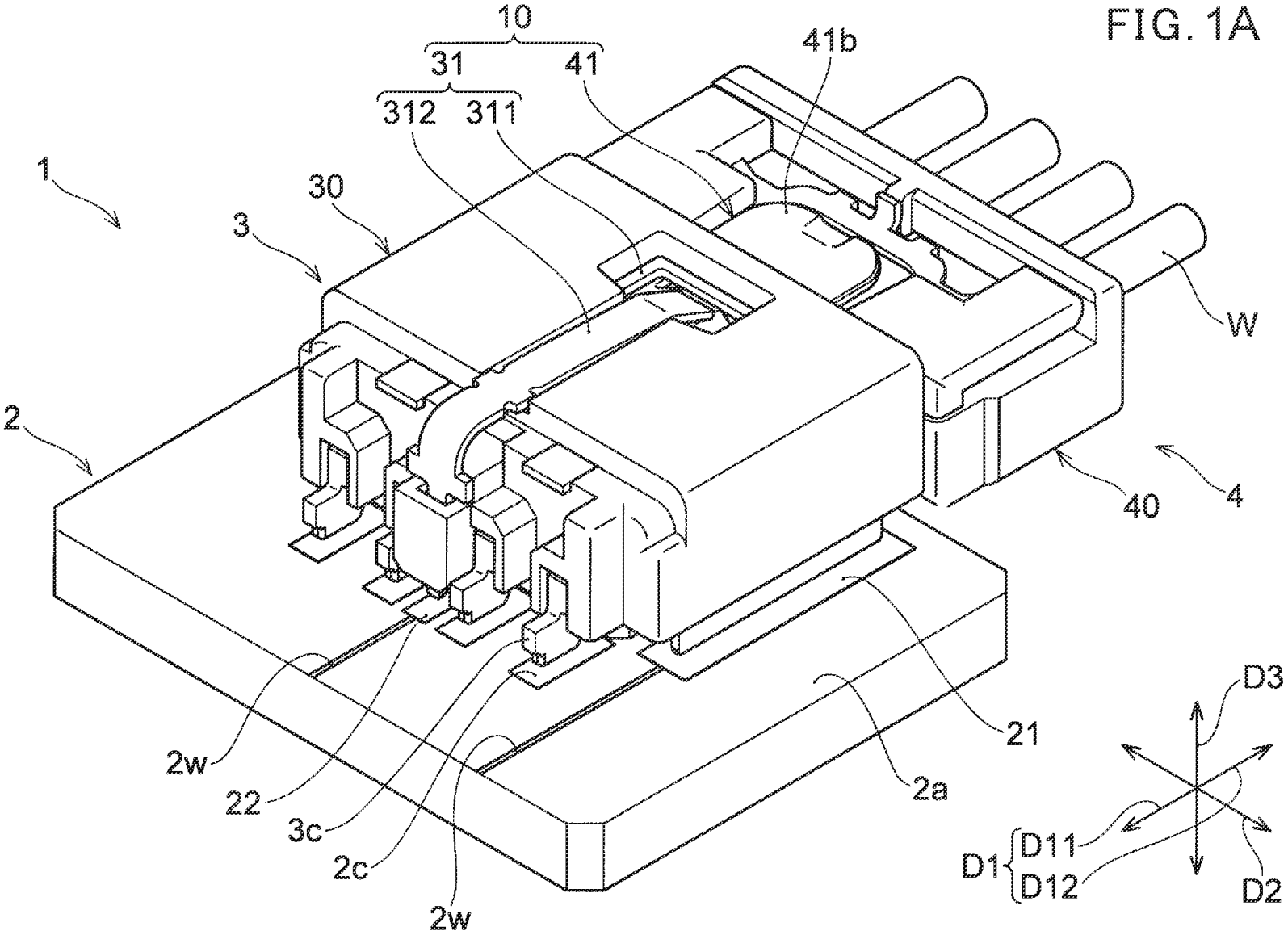
FIG. 1A is a perspective view showing one example of an electrical connection structure according to one embodiment of the disclosure.
Figure 1B:
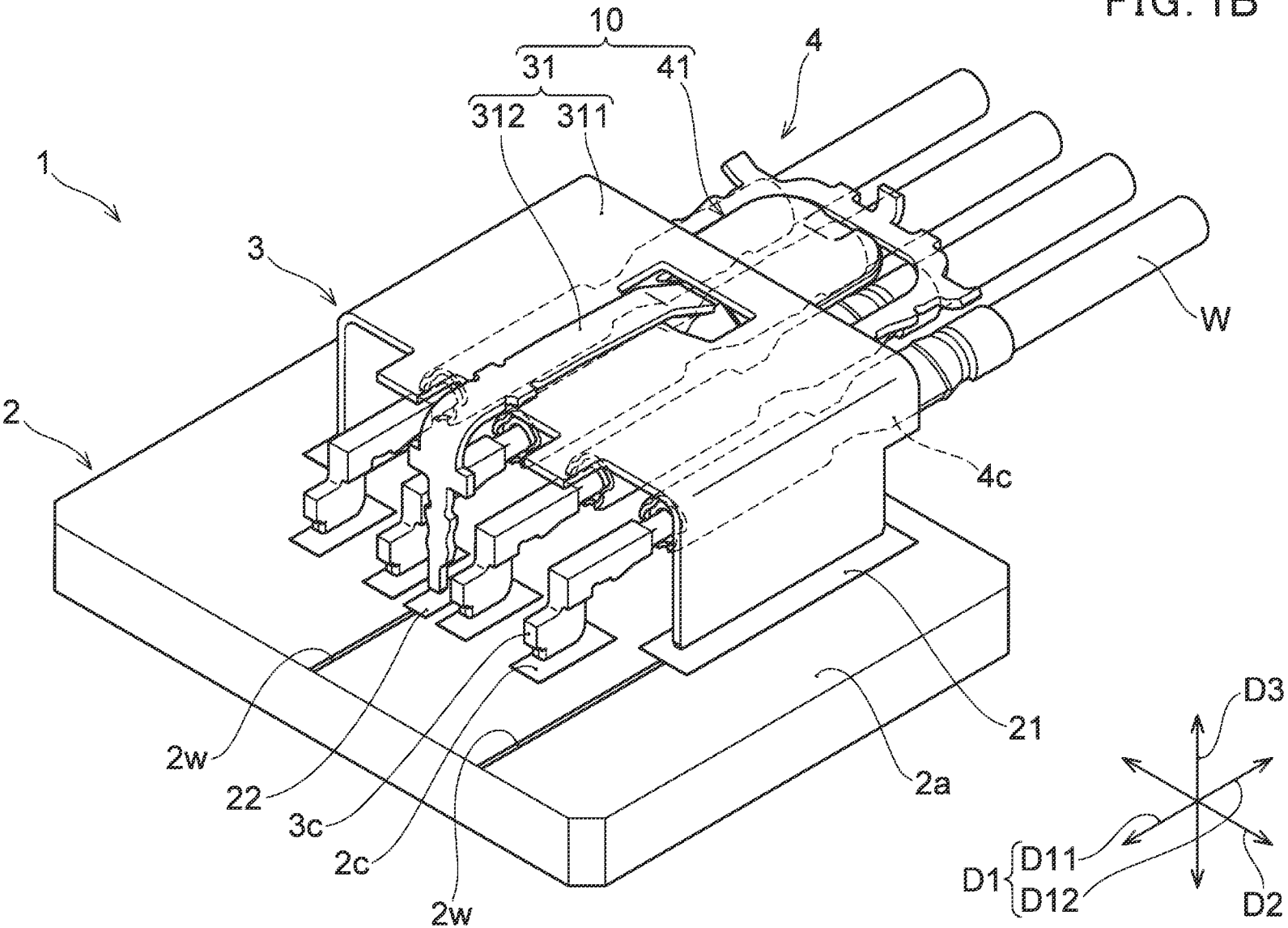
FIG. 1B is a perspective view in which a housing of a connector and a mating housing of a mating connector are removed from FIG. 1A.

FIG. 1A shows an electrical connection structure 1 according to the embodiment, while FIG. 1B shows the electrical connection structure 1 of FIG. 1A, with a part of components (a housing 30 of a connector 3 and a housing 40 of a mating connector 4 to be described below) being omitted therein. As shown in FIGS. 1A and 1B, the electrical connection structure 1 according to the embodiment is a connection structure to electrically connect a plurality of electrical apparatuses via a pair of connectors (the connector 3 and the mating connector 4). While the use of the electrical connection structure 1 is not particularly limited, according to the embodiment, the electrical connection structure 1 is an electrical connection structure for vehicle mounting, which electrical connection structure is to electrically connect between the electrical apparatuses mounted to an automobile. The electrical connection structure 1 comprises: a base member 2; a connector 3 being mounted to the base member 2 to be electrically connected thereto; and a mating connector 4 to be electrically connected to the connector 3 by being fitted thereto. According to the embodiment, the connector 3 and the mating connector 4 make up a so-called horizontal fitting type connector structure in which the mating connector 4 is fitted from the horizontal direction to a surface 2*a* of the base member 2, on which surface 2*a* the connector 3 is mounted. However, the connector 3 and the mating connector 4 can make up a so-called vertical fitting type connector structure in which the mating connector 4 is fitted from the vertical direction to the surface 2*a* of the base member 2, on which surface 2*a* the connector 3 is mounted.

According to the specification, a direction in which the mating connector 4 is fitted toward the connector 3 is called a fitting direction D11, while a direction opposite to the fitting direction D11, in which direction the mating connector 4 is separated from the connector 3, is called a separating direction D12. Moreover, according to the specification, both directions being the fitting direction D11 and the separating direction D12 are collectively called a fitting/separating direction (first direction) D1. According to the embodiment, the fitting direction D11 and the separating direction D12 refer to one direction of directions being parallel to the surface 2*a* of the base member 2. According to the specification, one direction to cross the fitting/separating direction D1 is called a second direction D2. The second direction D2 can also be called a width direction. According to the embodiment, the second direction D2 is one direction of directions being parallel to the surface 2*a* of the base member 2 and a direction to cross the fitting/separating direction D1. More specifically, the second direction D2 is one direction of directions being parallel to the surface 2*a* of the base member 2 and a direction being vertical to the fitting/separating direction D1. According to the specification, a direction to cross the fitting/separating direction D1 and the second direction D2 is called a third direction D3. The third direction D3 can also be called a height direction. According to the embodiment, the third direction D3 is one direction of directions to cross the surface 2*a* of the base member 2 and a direction to cross the fitting/separating direction D1. More specifically, the third direction D3 is a direction being vertical to the surface 2*a* of the base member 2 and a direction being vertical to the fitting/separating direction D1. According to the specification, in a case that terms of "upper" and "lower" are used, such as in "upper side" and "lower side", for example, a direction in which the connector 3 is mounted to the base member 2 can be called "lower" and the reverse thereof can be called "upper".

As shown in FIGS. 1A and 1B, the electrical connection structure 1 comprises a half-fitting detecting mechanism 10 to detect whether the mating connector 4 is fitted in a normal fitting state/a half-fitting state. The half-fitting detecting mechanism 10 includes: a half-fitting detecting portion 31 provided in the connector 3; and a short-circuiting member 41 being electrically conductive and provided in the mating connector 4. The half-fitting detecting portion 31 and the short-circuiting member 41 will be described below.

According to the specification, the above-mentioned normal fitting state refers to a state in which the connector 3 and the mating connector 4 are fitted to each other in a regular fitting position. On the other hand, the above-mentioned normal fitting state refers to a state in which, while the connector 3 and the mating connector 4 are close to being in the normal fitting state, but not completely fitted to each other, they are fitted to each other, but being fitted to each other while being in a position off the regular fitting position.

FIG. 2A shows the base member 2 and the connector 3 included in the electrical connection structure 1 according to the embodiment, while FIG. 2B shows the base member 2 and the connector 3 of FIG. 2A, with a part of components (the housing 30 of the connector 3 to be described below) being omitted. As shown in FIGS. 2A and 2B, the base member 2 is electrically connected to the connector 3 by the connector 3 being mounted thereto. According to the embodiment, the base member 2 is a wiring board. However, as long as the base member 2 is electrically connected to the connector 3 by the connector 3 being mounted thereto, it is not limited to the wiring board. According to the embodiment, the base member 2 comprises a wiring 2*w*, a connecting portion for terminal 2*c* to be electrically connected to a contact 3*c* (see FIG. 2B) of the connector 3; a connecting portion for mounting 21 to be electrically connected to an electrically conductive member 311 of the connector 3; and a connecting portion 22 for inspecting (see FIG. 1B) to be electrically connected to an inspecting member 312 of the connector 3. The connecting portion for mounting 21 and the connecting portion for inspecting 22 can be connected, via the wiring 2*w*, to a short-circuiting detecting circuit (not shown) to detect short circuiting between the electrically conductive member 311 and the inspecting member 312. The contact 3*c*, the electrically conductive member 311, and the inspecting member 312 of the connector 3 will be described below.

As shown in FIGS. 1A and 1B, the connector 3 is electrically connected to the base member 2 on one hand and is electrically connected to the mating connector 4 on the other hand. According to the embodiment, the connector 3 is a so-called surface mounting-type connector being mounted on the surface 2*a* of the base member 2 to be electrically connected to the base member 2. However, the connector 3 can be a connector being mounted to the base member 2 in a different form, such as a connector being mounted to a through hole or a notch provided in the base member 2 by being fitted thereto to be electrically connected to the base member 2. Moreover, according to the embodiment, as shown in FIG. 1B, the connector 3 is a female connector, while the mating connector 4 is a male connector. However, the connector 3 can be the male connector, while the mating connector 4 can be the female connector.

As shown in FIGS. 1A and 1B, the connector 3 comprises a half-fitting detecting portion 31 to detect whether the mating connector 4 is fitted thereto in the normal fitting state. The half-fitting detecting portion 31 does not produce short circuiting in the interior thereof when the connector 3 and the mating connector 4 are in the half-fitting state, while the half-fitting detecting portion 31 produces short circuiting in the interior thereof via the short-circuiting member 41 of the mating connector 4 to be described below when the connector 3 and the mating connector 4 are in the normal fitting state. In this way, the half-fitting state of the connector 3 and the mating connector 4 can be sensed. Details of the half-fitting detecting portion 31 will be described below. According to the specification, the expression "the connector 3 and the mating connector 4 being fitted to each other" and that similar thereto refer to the connector 3 and the mating connector 4 being fitted to each other with the connector 3 (specifically, an inner surface of a fitting portion 32 of the connector 3 to be described below) and the mating connector 4 (specifically, an outer surface of a mating fitting portion 42 of the mating connector 4 to be described below) being physically in contact with each other in any one direction to cross the fitting/separating direction D1 (specifically, any direction being vertical to the fitting/separating direction D1). According to the embodiment, the connector 3 (specifically, the inner surface of the fitting portion 32) and the mating connector 4 (specifically, the outer surface of the mating fitting portion 42) are in physical contact with each other to be fitted thereto in the second direction D2 and the third direction D3.

The connector 3 comprises the housing 30. According to the embodiment, as shown in FIG. 2A, the housing 30 holds the half-fitting detecting portion 31. The housing 30 can further hold the contact 3*c* (see FIG. 2B) to be described below. The housing 30 is formed with an insulating resin material, for example. In FIG. 2A, the housing 30 has a first wall portion (side wall portion) 301 and a second wall portion 302 (side wall portion) to cross the second direction D2 (being orthogonal thereto in FIG. 2A), and a third wall portion (top wall portion) 303 and a fourth wall portion 304 (bottom wall portion) to cross the third direction D3 (being orthogonal thereto in FIG. 2A).

According to the embodiment, as shown in FIG. 2A, the housing 30 comprises the fitting portion 32 to be fitted to the mating connector 4 (see FIG. 3). Specifically, the fitting portion 32 is fitted to the mating fitting portion 42 (see FIG. 3) of the connector 4 to be described below. The connector 3 and the mating connector 4 can be electrically connected with a good connection reliability when the fitting portion 32 and the mating fitting portion 42 are fitted to each other in the normal fitting state. In FIG. 2A, the fitting portion 32 is provided on the separating direction D12 side of the housing 30, and the mating connector 4 (see FIG. 3) fits thereto from the fitting direction D11. According to the embodiment, the fitting portion 32 is a fitting concave portion extending along the fitting/separating direction D1, which fitting concave portion has a housing space 32*h* into which housing space 32*h* the mating fitting portion 42 can be inserted and which housing space 32*h* can house the mating fitting portion 42, which mating fitting portion 42 is formed as a fitting convex portion. In FIG. 2A, the housing space 32*h* is defined by inner surfaces of the first wall portion 301, the second wall portion 302, the third wall portion 303, and the fourth wall portion 304.

Figure 4A:
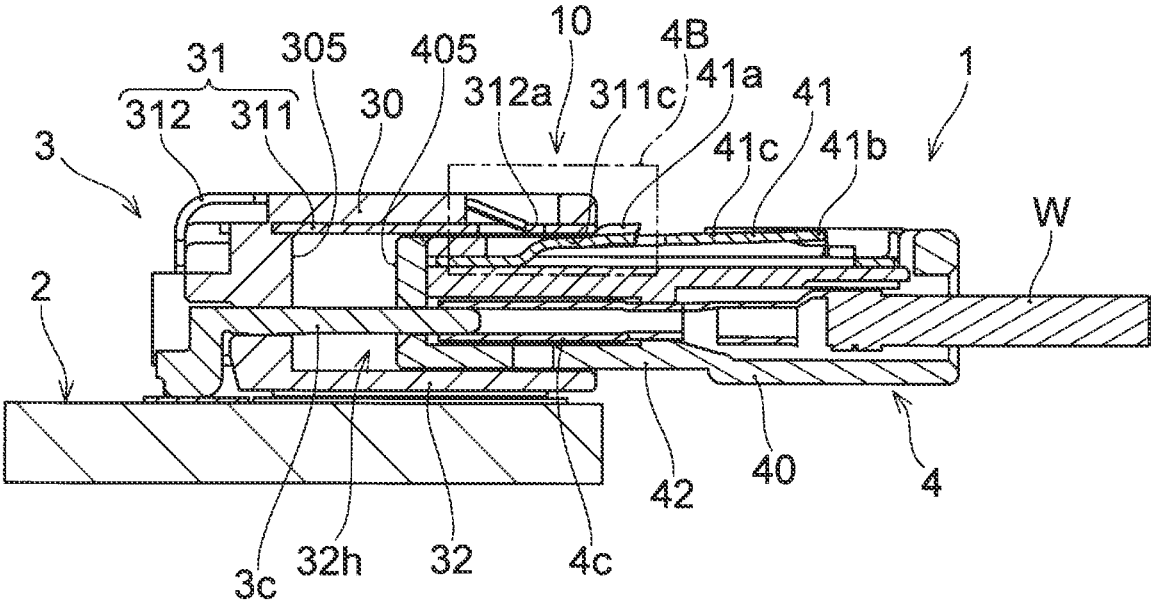
FIG. 4A is a cross-sectional view showing one example of a state in the middle of fitting of the electrical connection structure according to one embodiment of the disclosure.

According to the embodiment, the fitting portion 32 has, on the fitting direction D11 side within the housing space 32*h*, an opposing wall portion 305 (not shown in FIG. 2A;

see FIG. 4A) crossing the fitting/separating direction D1 (specifically, being orthogonal thereto) and opposing a mating opposing wall portion 405 (see FIGS. 3 and 4A) of the mating fitting portion 42. According to the embodiment, the connector 3 and the mating connector 4 can be in the normal fitting state when the opposing wall portion 305 and the mating opposing wall portion 405 are in contact with each other, or when they are almost in contact with each other.

As shown in FIG. 2A, according to the embodiment, the fitting portion 32 has a guide portion 32*a* to guide the mating connector 4 (see FIG. 3) in the fitting/separating direction D1. The fitting portion 32 having the guide portion 32*a* allows the mating connector 4 being forcibly fitted to the connector 3 in a direction oblique to the fitting/separating direction D1 to be suppressed, making it easy for the connector 3 and the mating connector 4 to be fitted to each other in the normal fitting state. Moreover, the mating connector 4 being forcibly fitted to the connector 3 while it is turned upside down, or a mating connector that cannot be paired, such as a mating connector having the different number of contacts, for example, being forcibly fitted to the connector 3 is suppressed, so that breaking of the connector 3 due to forcible fitting is also suppressed. According to the embodiment, the guide portion 32*a* is a guide ridge to guide a mating guide portion 42*a* of the mating fitting portion 42, which mating guide portion 42*a* is formed as a guide groove, and is provided so as to extend along the fitting/separating direction D1 at an inner surface of the fitting portion 32. However, the guide portion 32*a* can be provided as the guide groove, while the mating guide portion 42*a* can be provided as the guide ridge. Moreover, while the guide portion 32*a* is provided in a plurality (four in FIG. 2A) on the inner surface of the fourth wall portion (bottom wall portion) 304 in FIG. 2A, the arrangement and the number of the guide portion 32*a* are not particularly limited as long as it does not hinder detecting of the half-fitting state by the half detecting portion 31.

According to the embodiment, as shown in FIG. 2B, the connector 3 comprises the contact 3*c* to be electrically connected to the base member 2 and the mating connector 4 (see FIG. 3). Specifically, the contact 3*c* is electrically connected to a mating contact 4*c* (see FIG. 3) on the separating direction D12 side by being in contact therewith and is electrically connected to the connecting portion for terminal 2*c* of the base member 2 on the fitting direction D11 side by a solder. The contact 3*c* is formed with an electrically conductive metal material, for example. According to the embodiment, the contact 3*c* is a male contact, and, when the mating connector 4 is fitted to the connector 3, it is inserted into the mating contact 4*c* to be electrically connected thereto, which mating contact 4*c* is a female contact of the mating connector 4 to be described below. However, in a case that the contact 3*c* is the female contact, the mating contact 4*c* can also be configured to be the male contact. While the shape of the contact 3*c* is not particularly limited, according to the embodiment, the contact 3*c* extends along the fitting/separating direction D1 and is formed in a shape of a pin to be inserted through the housing 30 (see FIG. 2A). In FIG. 2B, the contact 3*c* is provided in a plurality (specifically, 1×4, or four) such that it projects into the housing space 32*h* of the fitting portion 32. However, only the singular contact 3*c* can be provided, so that the number and arrangement (for example, the number of rows and columns) of the contact 3*c* are appropriately changed depending on the use of the electrical connection structure 1.

As described above, the half-fitting detecting portion 31 is a portion to detect the half-fitting state of the connector 3 and the mating connector 4. The half-fitting detecting portion 31 can detect the half-fitting state by the short-circuiting member 41 of the mating connector 4 being in non-contact with an inspecting member 312 as described below when the mating connector 4 is fitted to the connector 3 in the half-fitting state. The half-fitting detecting portion 31 includes an electrically conductive member 311 to be in contact with the short-circuiting member 41 and the electrically conductive inspecting member 312 provided in a non-contact state with respect to the electrically conductive member 311.

As shown in FIGS. 2A and 2B, the electrically conductive member 311 is a member to mount the connector 3 to the base member 2. The electrically conductive member 311 is electrically connected to the base member 2. With the electrically conductive member 311 being provided, the connector 3 is allowed to be connected to the base member 2 not only with the contact 3*c*, but also with the electrically conductive member 311, so that the strength of connection of the connector 3 to the base member 2 increases, and the connection reliability also improves. When the mating connector 4 (see FIG. 3) is fitted to the connector 3 in the normal fitting state, the electrically conductive member 311 is in contact with the short-circuiting member 41 of the mating connector 4. Short circuiting between the electrically conductive member 311 and the short-circuiting member 41 will be described below. As long as the connector 3 can be mounted to the base member 2, the shape and arrangement of the electrically conductive member 311 is not particularly limited. According to the embodiment, as shown in FIG. 2B, the electrically conductive member 311 is formed with a bent metal plate and has a C letter shape so as to surround the contact 3*c* as viewed from the fitting/separating direction D1. Moreover, according to the embodiment, as shown in FIG. 2A, the electrically conductive member 311 is connected to the connecting portion for mounting 21 of the base member 2 at both ends of the housing 30 in the second direction D2 as viewed from the fitting/separating direction D1. As shown in FIG. 2A, the electrically conductive member 311 can be provided so as to be positioned on an inner surface of the housing 30 of the connector 3 such that it makes up at least a part of the fitting portion 32. In this case, in the fitting portion 32, no other member is interposed between the mating connector 4 and the electrically conductive member 311, so that misalignment of the electrically conductive member 311 with respect to the fitting portion 32 due to a dimensional error of the other member is suppressed. Thus, detecting of the half-fitting state by the half-fitting detecting portion 31 can be carried out with high accuracy. According to the embodiment, the electrically conductive member 311 is provided so as to be positioned on an inner surface of the housing 30 of the connector 3 in the second direction D2 and the third direction D3. More specifically, the electrically conductive member 311 is provided so as to be positioned on inner surfaces of the first wall portion 301, the second wall portion 302, and the third wall portion 303. In this case, in the two directions (the second direction D2 and the third direction D3), misalignment of the electrically conductive member 311 is suppressed, making it possible to further carry out, with high accuracy, detecting of the half-fitting state by the half-fitting detecting portion 31. However, the electrically conductive member 311 can be provided so as to be positioned on an inner surface of any one of the first wall portion 301, the second wall portion 302, the third wall portion 303, and the fourth wall portion 304. Moreover, the electrically conductive member 311 can be buried into the housing 30 without being exposed from the inner surface of the housing 30.

According to the embodiment, as shown in FIGS. 2A and 2B, the electrically conductive member 311 has an engaging portion 311*a* (see FIG. 2B) to engage with the short-circuiting member 41 (see FIG. 3) of the mating connector 4. However, as long as the engaging portion 311*a* can engage with the mating connector 4, the engaging portion 311*a* can also be formed in a portion of the connector 3 other than the electrically conductive member 311, such as the housing 30, for example. The engaging portion 311*a* engages with a mating engaging portion 41*a* of the mating connector 4. The engaging portion 311*a* being engaged with the mating engaging portion 41*a* allows separating of the mating connector 4 from the connector 3 to be suppressed. The engaging portion 311*a* engages with the mating engaging portion 41*a* when the mating connector 4 is fitted to the connector 3 in the normal fitting state. The engaging portion 311*a* engaging with the mating engaging portion 41*a* makes it possible to hold a connection between the connector 3 and the mating connector 4 in the normal fitting state. According to the embodiment, the engaging portion 311*a* is provided in the electrically conductive member 311. Specifically, the engaging portion 311*a* is an engaging concave portion formed with a through hole 311*b*, which engaging concave portion is to engage with the mating engaging portion 41*a* as an engaging convex portion. More specifically, the engaging portion 311*a* is an inner wall on the separating direction D12 side of the through hole 311*b* and engages with a wall portion on the separating direction D12 side of the mating engaging portion 41*a* being an engaging convex portion.

According to the embodiment, as shown in FIGS. 2A and 2B, the electrically conductive member 311 has the through hole 311*b* being provided in correspondence with the contact part 312*a* of the inspecting member 312 to be described below. According to the embodiment, along with having the engaging portion 311*a* described above, the through hole 311*b* provides a space that can be accessible by both the short-circuiting member 41 of the mating connector 4 and the inspecting member 312. Specifically, the through hole 311*b* is provided in shape and size that can house therein the contact part 312*a* and the mating engaging portion 41*a* of the short-circuiting member 41. According to the embodiment, the mating connector 4 is arranged to be fitted to the connector 3 in a regular fitting position when the mating engaging portion 41*a* is housed in the through hole 311*b*. In FIGS. 2A and 2B, the through hole 311*b* is formed in a shape (pentagonal shape), which pentagonal shape and a shape projecting in the third direction D3 (upward direction) of the mating engaging portion 41*a* are fitted to each other. However, the shape and size of the through hole 311*b* are not particularly limited as long as the through hole 311*b* can provide access to the short-circuiting member 41 and the inspecting member 312. According to the embodiment, as shown in FIG. 2A, the through hole 311*b* is provided at the center of the third wall portion 303 in the second direction D2, which third wall portion 303 is formed with the electrically conductive member 311. Moreover, according to the embodiment, as shown in FIG. 2B, the through hole 311*b* is provided toward the separating direction D12 in the electrically conductive member 311. However, the arrangement of the through hole 311*b* is appropriately changed depending on the arrangement of the short-circuiting member 41 and the inspecting member 312.

According to the embodiment, the electrically conductive member 311 has an abutting portion 311*c* to abut on the short-circuiting member 41. The abutting portion 311*c* short-circuits between the electrically conductive member 311 and the short-circuiting member 41 by abutting on the short-circuiting member 41 of the mating connector 4. According to the embodiment, the abutting portion 311*c* is formed with the electrically conductive member 311 being positioned on an inner surface of the housing 30, and is provided on at least one of the fitting direction D11 side and the separating direction D12 side with respect to the through hole 311*b*. In FIGS. 2A and 2B, the abutting portion 311*c* is provided on the separating direction D12 side of an inner surface of the third wall portion 303, which inner surface is formed with the electrically conductive member 311.

The inspecting member 312 is a member to inspect a fitting state of the connector 3 and the mating connector 4. When the mating connector 4 is fitted to the connector 3 in the normal fitting state, the inspecting member 312 short-circuits with the electrically conductive member 311 via the short-circuiting member 41 of the mating connector 4. Thus, whether the inspecting member 312 and the electrically conductive member 311 are short circuited therebetween can be detected to inspect the fitting state of the connector 3 and the mating connector 4. The shape and arrangement of the inspecting member 312 are not particularly limited as long as the inspecting member 312 can be in contact with the short-circuiting member 41. According to the embodiment, as shown in FIGS. 2A and 2B (see also FIGS. 1A and 2B), the inspecting member 312 extends along the fitting/separating direction D1, the end on the fitting direction D11 side is electrically connected to the base member 2, and the end (a contact part 312*a* to be described below) on the separating direction D12 side is arranged in correspondence with the through hole 311*b* of the electrically conductive member 311. Specifically, the inspecting member 312 is formed in an L letter shape as viewed from the second direction D2, extends along the third direction D3 such that it extends along a rear surface (surface on the fitting direction D11 side) of the housing 30 on one end side (fitting direction D11 side), and extends along the fitting/separating direction D1 such that it extends at a distance with respect to an outer surface of the electrically conductive member 311 on the other end side (separating direction D12 side). As described above, in a case that the through hole 311*b* is located toward the separating direction D12 of the electrically conductive member 311, the length of the inspecting member 312 in the separating direction D12 is greater, so that the elastic force of the inspecting member 312 does not increase excessively, making it easy to adjust the contact force of the inspecting member 312 to the short-circuiting member 41. In FIGS. 2A and 2B (see also FIGS. 1A and 2B), the inspecting member 312 bends, on the other end side, in the third direction (downward direction) D3 after extending along the separating direction D12 such that the end of the other end side is housed in the through hole 311*b*.

The inspecting member 312 has a contact part 312*a* to be in contact with the short-circuiting member 41. When the mating connector 4 is fitted to the connector 3 in the normal fitting state, the contact part 312*a* is in contact with the mating engaging portion 41*a* (see FIG. 3) of the mating connector 4. According to the embodiment, the contact part 312*a* is provided at the end on the separating direction D12 side of the inspecting member 312. However, as long as the contact part 312*a* can be in contact with the mating engaging portion 41*a*, it is not particularly limited and can be provided in a different form, such as, when the inspecting member 312 is bent in a V letter shape on the separating direction D12 side, the contact part 312*a* being provided in a portion being bent as mentioned above. According to the embodiment, when a contact portion of the contact part 312*a* and the mating engaging portion 41*a* and a contact portion of the electrically conductive member 311 and the short-circuiting member 41 are in the normal fitting state, they are lined up at a distance along the fitting/separating direction D1. In this case, the short-circuiting direction of the half-fitting detecting portion 31 and the short-circuiting member 41 and the fitting/separating direction D1 of the connector 3 and the mating connector 4 match each other, making it easy to design a short-circuiting form of the half-fitting detecting portion 31 and the short-circuiting member 41 in accordance with a fitting form of the connector 3 and the mating connector 4.

FIG. 3 shows the mating connector 4 included in the electrical connection structure 1 according to the embodiment. The mating connector 4 is fitted/separated in the fitting/separating direction D1 with respect to the connector 3 (see FIG. 2A). The mating connector 4 can be electrically connected to the connector 3 by being fitted to the connector 3 from the fitting direction D11 and can release an electrical connection to the connector 3 by being separated from the connector 3 in the separating direction D12. According to the embodiment, the mating connector 4 is a so-called electrical wire connection-type connector being, on one hand, electrically connected to the connector 3 and, on the other hand, electrically connected to an electrical wire W. However, the mating connector 4 can be a connector of a different form, such as the above-described surface mounting-type connector to be electrically connected to a base member (specifically, a wiring board).

As shown in FIG. 3, the mating connector 4 comprises an electrically connecting short-circuiting member 41. The short-circuiting member 41 is not in contact with the inspecting member 312 (see FIG. 2A) when the connector 3 (see FIG. 2A) and the mating connector 4 are in the half-fitting state, while it is in contact with the inspecting member 312 when it is in the normal fitting state. In this way, the half-fitting state of the connector 3 and the mating connector 4 can be sensed.

According to the embodiment, as shown in FIG. 3, the mating connector 4 comprises a mating housing 40 to hold the short-circuiting member 41. The mating housing 40 can further hold the mating contact 4*c* as described below. The mating housing 40 is formed with an insulating resin material, for example. In FIG. 3, the mating housing 40 has a first mating wall portion (side wall portion) 401 and a second mating wall portion (side wall portion) 402 to cross the second direction D2 (being orthogonal in FIG. 3), and a third mating wall portion (top wall portion) 403 and a fourth mating wall portion (bottom wall portion) 404 to cross the third direction D3 (being orthogonal in FIG. 3).

According to the embodiment, the mating housing 40 comprises a mating fitting portion 42 to be fitted to the connector 3 (see FIG. 2A). Specifically, the mating fitting portion 42 is a portion to be fitted to the fitting portion 32 (see FIG. 2A) of the connector 3. In FIG. 3, the mating fitting portion 42 is provided on the fitting direction D11 side of the mating housing 40 and fitted to the connector 3 from the fitting direction D11. According to the embodiment, the mating fitting portion 42 is a fitting convex portion extending along the fitting/separating direction D1, which fitting convex portion can be inserted into and housed in the housing space 32*h* (see FIG. 2A) of the fitting portion 32 formed as a fitting concave portion. Specifically, the mating fitting portion 42 has a parallelepiped shape defined by the first mating wall portion 401, the second mating wall portion 402, the third mating wall portion 403, and the fourth mating wall portion 404. According to the embodiment, the mating fitting portion 42 has, on the fitting direction D11 side, the mating opposing wall portion 405 to cross the fitting/separating direction D1 (specifically, being orthogonal thereto) and oppose the opposing wall portion 305 (see FIG. 4A) of the fitting portion 32.

According to the embodiment, the mating fitting portion 42 has the mating guide portion 42*a* to be guided in the fitting/separating direction D1 by the connector 3 in correspondence with the guide portion 32*a* of the connector 3. In FIG. 3, the mating guide portion 42*a* is provided in a plurality (four in FIG. 2A) as a guide groove extending along the fitting/separating direction D1 at an outer surface of the fourth mating wall portion 404 of the mating fitting portion 42 in correspondence with the guide portion 32*a* of the connector 3. However, the shape and arrangement, and the number of the mating guide portion 42*a* are appropriately changed depending on the shape, the number, and the arrangement of the guide portion 32*a* of the connector 3.

According to the embodiment, as shown in FIG. 3, the mating connector 4 comprises the mating contact 4*c* to be electrically connected to the connector 3 (see FIG. 2A). Specifically, the mating contact 4*c* is electrically connected to the contact 3*c* (see FIG. 2B) of the connector 3 on the fitting direction D11 side by being in contact therewith and is electrically connected to the electrical wire W on the separating direction D12 side by crimping. The mating contact 4*c* is formed with an electrically conductive metal material, for example. Specifically, the mating contact 4*c* is electrically connected to the contact 3*c* when the mating connector 4 is fitted to the connector 3. While the mating contact 4*c* is provided in a plurality (specifically, 1×4, or four) in FIG. 3, only one thereof can be provided, so that the number and arrangement (for example, the number of rows and columns) of the mating contact 4*c* are appropriately changed depending on the number and arrangement of the contact 3*c* of the connector 3.

As described above, the short-circuiting member 41 is a member to short circuit with the half-fitting detecting portion 31 of the connector 3. The short-circuiting member 41 is in contact with the electrically conductive member 311 and the inspecting member 312 to short-circuit the electrically conductive member 311 and the inspecting member 312 when the mating connector 4 is fitted to the connector 3 in the normal fitting state, while the short-circuiting member 41 is in non-contact with the inspecting member 312 not to short-circuit the electrically conductive member 311 and the inspecting member 312 when it is fitted thereto in the half-fitting state. In this way, the inspecting member 312 and the electrically conductive member 311 are short circuited via the short-circuiting member 41 in the normal fitting state, while the inspecting member 312 and the electrically conductive member 311 are not short-circuited in the half-fitting state. In this way, the fitting state of the connector 3 and the mating connector 4 can be detected. According to the embodiment, as shown in FIG. 3, the short-circuiting member 41 is a cantilevered elastic member being provided at the center of the third mating wall portion 403 in the fitting/separating direction D1 and the second direction D2 and extending in the fitting/separating direction D1. More specifically, the short-circuiting member 41 is formed with one metal plate having a shape of an arm extending from the fixed end side to the free end side toward the separating direction D12 while slightly being inclined to the third direction (upward direction) D3 side. However, the shape and arrangement of the short-circuiting member 41 is not particularly limited as long as the short-circuiting member 41 can be in contact with the inspecting member 312 and the electrically conductive member 311 in the normal fitting state.

Figure 4B:
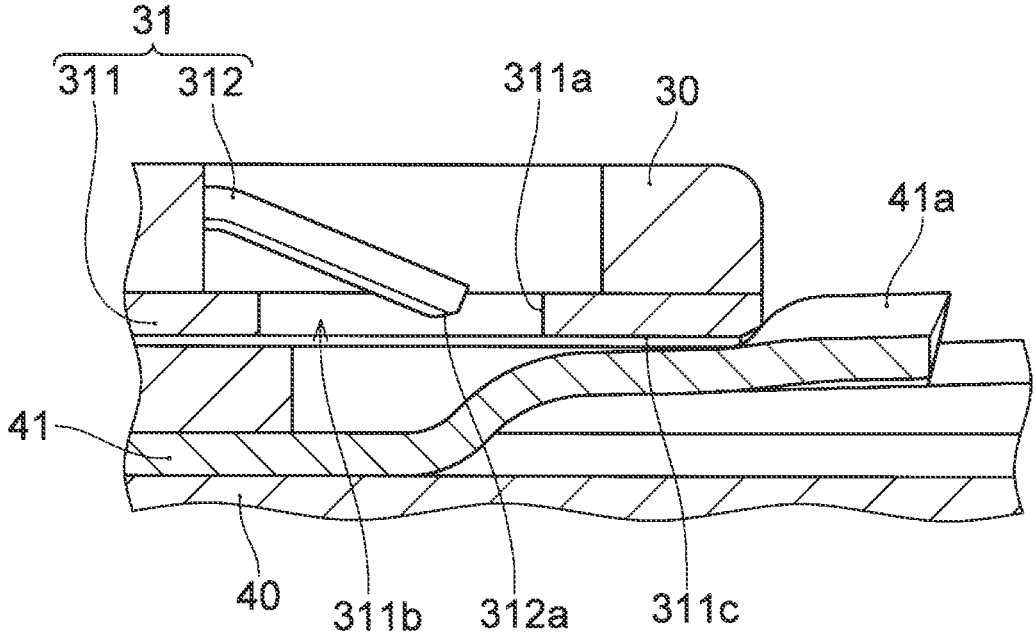
FIG. 4B is an enlarged view of a 4B portion of 4A.
Figure 5A:
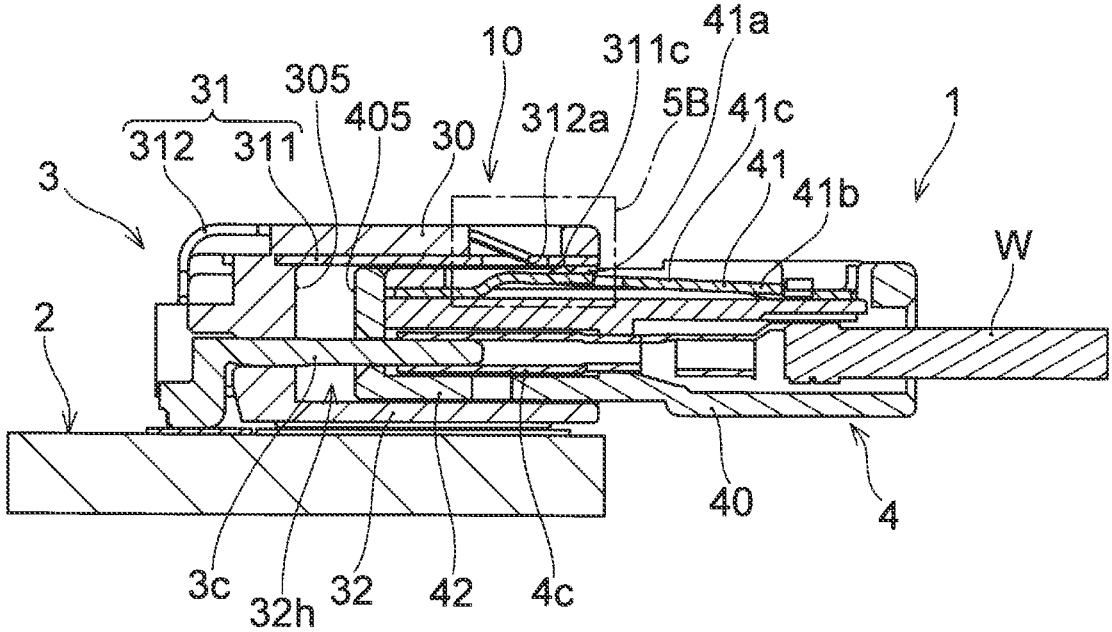
FIG. 5A is a cross-sectional view showing a state in the middle of fitting of the electrical connection structure, in which state the mating connector moved in a fitting direction with respect to the connector from the state shown in FIG. 4A.
Figure 5B:
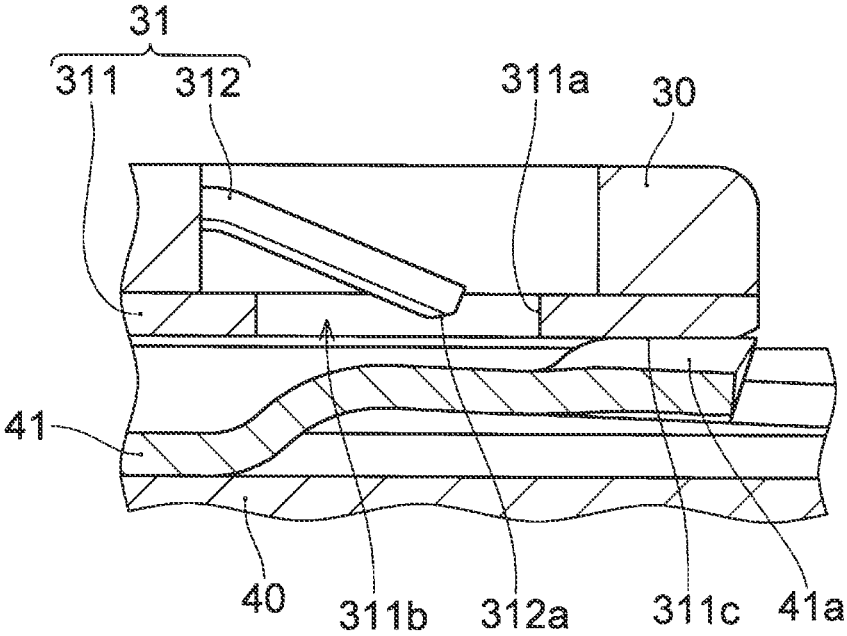
FIG. 5B is an enlarged view of a 5B portion of 5A.

As shown in FIG. 3, the short-circuiting member 41 has the mating engaging portion 41*a* to engage with the electrically conductive member 311 (see FIG. 2A). When the mating connector 4 is fitted to the connector 3 in the normal fitting state, the mating engaging portion 41*a* engages with the engaging portion 311*a* (see FIG. 2A) of the electrically conductive member 311, and is also in contact with the contact part 312*a* of the inspecting member 312. According to the embodiment, the mating engaging portion 41*a* is an engaging convex portion formed with a projecting portion of the short-circuiting member 41, which projecting portion projects in the third direction (upward direction) D3 and engages with the engaging portion 311*a* as an engaging concave portion. Specifically, the mating engaging portion 41*a* is a wall portion on the separating direction D12 side of the projecting portion. According to the embodiment, the mating engaging portion 41*a* is integrally formed with the short-circuiting member 41 being a metal plate. In this case, compared to a case of forming the mating engaging portion 41*a* with a resin, for example, even when the mating engaging portion 41*a* is downsized or slimmed, the mating engaging portion 41*a* can demonstrate a sufficient locking capability, and also has a holding force of engaging with the engaging portion 311*a*. Moreover, even when the mating engaging portion 41*a* is downsized or slimmed, a sufficient audible click sound can be generated when the mating engaging portion 41*a* and the engaging portion 311*a* are engaged with each other, so that the connector 3 and the mating connector 4 being fitted in the half-fitting state is suppressed. According to the embodiment, as shown in FIGS. 4B and 5B, the mating engaging portion 41*a* is in sliding contact with the electrically conductive member 311 on the separating direction D12 side with respect to the through hole 311*b* by the short-circuiting member 41 being pressed against the electrically conductive member 311 to be elastically deformed when the mating connector 4 moves in the fitting direction D11 to be fitted to the connector 3. As described above, when the through hole 311*b* is located toward the separating direction D12 of the electrically conductive member 311 (see FIG. 2A), the length of the abutting portion 311*c* (the length between the through hole 311*b* and the end edge of the electrically conductive member 311 in the separating direction D12) is less. In this case, the distance in which the mating engaging portion 41*a* and the abutting portion 311*a* are in sliding contact with each other is less, so that a sense of incongruity due to a sliding contact at the time of operation of the mating connector 4 being fitted to the connector 3 can be suppressed.

Figure 6A:
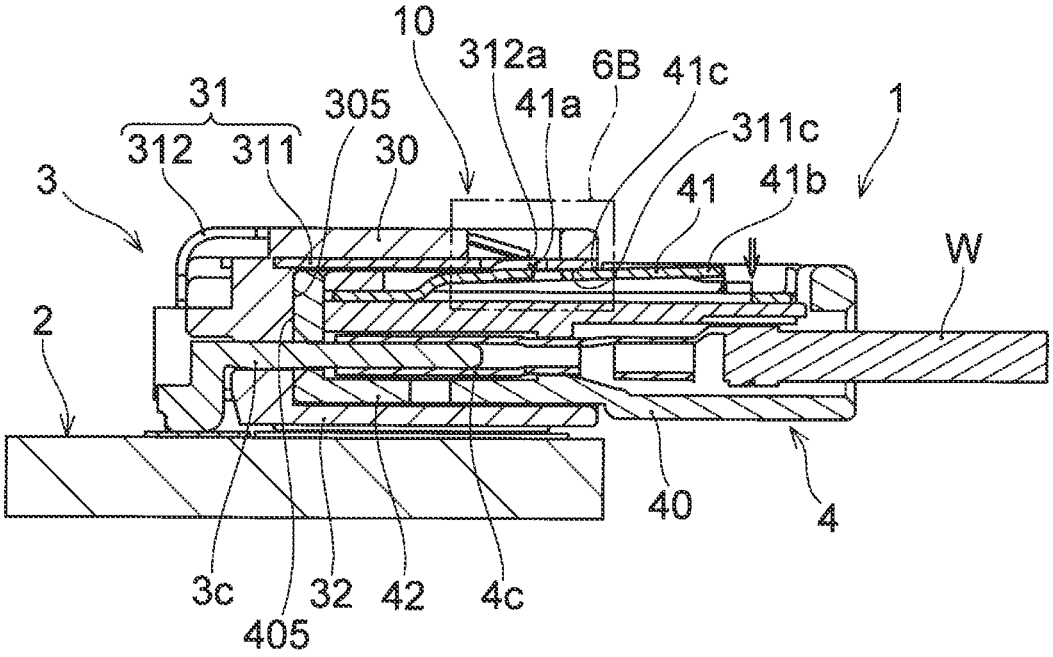
FIG. 6A is a cross-sectional view showing one example of a normal fitting state of the electrical connection structure according to one embodiment of the disclosure.
Figure 6B:
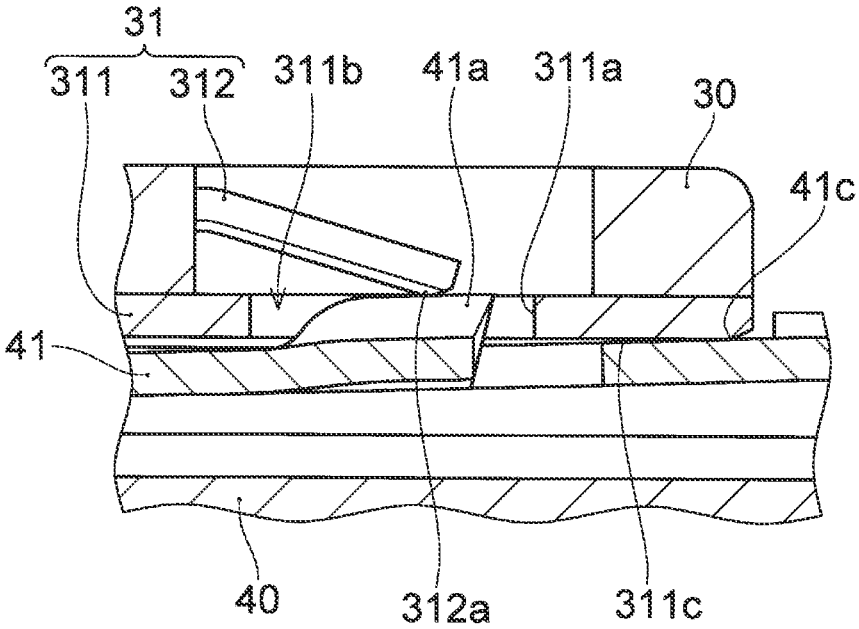
FIG. 6B is an enlarged view of a 6B portion of 6A.

As shown in FIG. 6B, when the mating connector 4 is fitted to the connector 3 in the normal fitting state, the mating engaging portion 41*a* is in contact with the contact part 312*a* of the inspecting member 312. In other words, the short-circuiting member 41 has a function to engage with the electrically conductive member 311 and a function to be in contact with the inspecting member 312. According to the embodiment, the mating engaging portion 41*a* is in contact with the contact part 312*a* by the short-circuiting member 41 being elastically restored such that it is positioned in the through hole 311*b* when the mating connector 4 is fitted to the connector 3 in the normal fitting state.

According to the embodiment, as shown in FIG. 3, the short-circuiting member 41 has an operating portion 41*b* that can release engaging of the connector 3 (see FIG. 2A) and the mating connector 4 with a pressing operation. The short-circuiting member 41 having the operating portion 41*b* makes it easy to release engaging of the connector 3 and the mating connector 4, also making it easy to remove the mating connector 4 from the connector 3. Specifically, as shown in FIG. 1A, the operating portion 41*b* is provided on the separating direction D12 side of the short-circuiting member 41 being exposed in the fitting state such that it can be easily operated in the normal fitting state of the connector 3 and the mating connector 4. According to the embodiment, in the normal fitting state, engaging of the engaging portion 311*a* and the mating engaging portion 41*a* is released by pressing the operating portion 41*b* in the third direction (downward direction) D3, making it possible to remove the mating connector 4 from the connector 3.

According to the embodiment, as shown in FIG. 3, the short-circuiting member 41 has the short-circuiting portion 41*c* to abut on the electrically conductive member 311 (see FIG. 2A) of the connector 3 in the normal fitting state. Specifically, the short-circuiting portion 41*c* abuts on the abutting portion 311*c* (see FIG. 2A) of the electrically conductive member 311. According to the embodiment, the short-circuiting portion 41*c* is provided on at least one of the fitting direction D11 side and the separating direction D12 side with respect to the mating engaging portion 41*a*. In FIG. 3, the short-circuiting portion 41*c* is provided on the separating direction D12 side of the mating engaging portion 41*a*, and more specifically, is provided in the short-circuiting member 41 between the mating engaging portion 41*a* and the operating portion 41*b*. However, the position of the short-circuiting portion 41*c* is appropriately changed in accordance with the position of the abutting portion 311*c* in the connector 3.

(Method of Detecting Half-Fitting State in Electrical Connection Structure According to the Embodiment)

Next, with reference to FIGS. 4A to 6B, one example of a method of detecting the fitting state in the electrical connection structure 1 according to the embodiment will be described. Each of FIGS. 4A, 5A, and 6A is a cross-sectional view in which the central axis of the second contact 3*c* from the front of the paper is cut in a cross section being vertical to the second direction D2 in FIG. 1A. Moreover, each of FIGS. 4B, 5B, and 6B is an enlarged view of a 4B portion, a 5B portion, and a 6B portion in FIGS. 4A, 5A, and 6A. The method of detecting of the fitting state in the electrical connection structure 1 shown below is merely exemplary, so that the electrical connection structure according to the disclosure is not limited to the embodiment below.

As shown in FIG. 4A, according to the embodiment, when the mating connector 4 is moved in the fitting direction D11 toward the connector 3, the mating fitting portion 42 starts to be fitted to the fitting portion 32 and the mating contact 4*c* starts to be fitted to the contact 3*c*. When the mating connector 4 is further moved in the fitting direction D11, as shown in FIG. 4B, the mating engaging portion 41*a* of the mating connector 4 abuts on the opening edge (side wall on the separating direction D12 side of the electrically conductive member 311) of the connector 3.

As shown in FIG. 5A, according to the embodiment, when the mating connector 4 is further moved in the fitting direction D11 toward the connector 3, the mating engaging portion 41*a* is pressed toward the housing space 32*h* of the fitting portion 32 by the abutting portion 311*c* of the electrically conductive member 311. Thus, as shown in FIG. 5B, the mating engaging portion 41*a* of the short-circuiting member 41 moves while it is in sliding contact with the electrically conductive member 311 on the separating direction D12 side with respect to the through hole 311*b* by being elastically deformed in the third direction (downward direction) D3 by pressing. According to the embodiment, the short-circuiting member 41 has a shape of an arm in which the free end side extends toward the separating direction D12, so that the free end side is elastically deformed easily in the third direction (downward direction) D3 by pressing.

As shown in FIG. 6A, according to the embodiment, when the mating connector 4 is further moved in the fitting direction D11 toward the connector 3, as shown in FIG. 6B, the mating engaging portion 41*a* moves to a position corresponding to the though hole 311*b*. At that time, the mating engaging portion 41*a* intrudes into the through hole 311*b* to be housed therein by the short-circuiting member 41 being elastically restored such that it is released from pressing by the abutting portion 311*c*. In this way, the mating connector 4 is fitted to the connector 3 in the normal fitting state and the mating contact 4*c* is electrically connected to the contact 3*c* in the normal state. At the same time therewith, the mating engaging portion 41*a* is in contact with the contact part 312*a* being arranged at a position corresponding to the through hole 311*b* (specifically being arranged in the through hole 311*b*) and presses the contact part 312*a* in the third direction (upward direction) D3 to elastically deform the contact part 312*a*. In this way, a sufficient contact force between the mating engaging portion 41*a* and the contact part 312*a* is obtained. At the same time, the short-circuiting member 41 is in contact with the electrically conductive member 311 at the short-circuiting portion 41*c*. Thus, in the normal fitting state, the inspecting member 312 short-circuits with the electrically conductive member 311 via the short-circuiting member 41. On the other hand, according to the embodiment, in the half-fitting state shown in FIGS. 5A and 5B, for example, the mating engaging portion 41*a* does not intrude into the through hole 311*b*, so that the mating engaging portion 41*a* is not in contact with the contact part 312*a*. Thus, in the half-fitting state, the inspecting member 312 does not also short-circuit with the electrically conductive member 311. In this way, the half-fitting state can be sensed in accordance with whether the electrically conductive member 311 and the inspecting member 312 are short-circuited.

As shown in FIG. 6B, according to the embodiment, when the mating connector 4 is fitted to the connector 3 in the normal fitting state, the mating engaging portion 41*a* engages with the engaging portion 311*a* in the separating direction D12. Thus, the normal fitting state can be held by engaging of the engaging portion 311*a* and the mating engaging portion 41*a*. As shown in FIG. 6A (see arrow shown), the engaging of the engaging portion 311*a* and the mating engaging portion 41*a* can be released by an operation of pressing the operating portion 41*b*. Thus, the mating connector 4 can easily be removed from the connector 3 by pulling out the mating connector 4 in the separating direction D12 while pressing the operating portion 41*b*.

While the short-circuiting member 41 extending in the fitting/separating direction D1 has a fixed end on the fitting direction D11 side and a free end on the separating direction D12 side in FIGS. 4A to 6B, it can have a free end on the fitting direction D11 side and a fixed end on the separating direction D12 side. Moreover, as in FIGS. 4A to 6B, even in a case that the short-circuiting member 41 has a fixed end on the fitting direction D11 side and a free end on the separating direction D12 side, the shape of the short-circuiting member 41 is not limited to the shape shown. For example, in FIGS. 4A to 6B, toward the free end side (separating direction D12 side) from the fixed end side (the fitting direction D11 side), the short-circuiting member 41 has a shape of an arm extending toward the upward direction (one direction of the third directions D3). However, toward the free end side (separating direction D12 side) from the fixed end side (the fitting direction D11 side), the short-circuiting member 41 can have a shape of an arm extending toward the downward direction (one direction of the third directions D3). In this case, the short-circuiting member 41 can be in contact with an inner surface of the electrically conductive member 311 on the fitting direction D11 side of the through hole 311*b*, so that the abutting portion 311*c* can be provided on the fitting direction D11 side of the through hole 311*b*. Moreover, the short-circuiting member 41 can have a shape of an arm extending toward the free end side (the separating direction D12 side) from the fixed end side (the fitting direction D11 side) while maintaining the position in the third direction D3. In this case, the short-circuiting member 41 can be in contact with an inner surface of the electrically conductive member 311 on either one of the fitting direction D11 side and the separating direction D12 side of the through hole 311*b*, so that the abutting portion 311*c* can be provided on the fitting direction D11 side and the separating direction D12 side of the through hole 311*b*. Similarly for a case in which the short-circuiting member 41 has a free end on the fitting direction D11 side and has a fixed end on the separating direction D12 side, the shape of the short-circuiting member 41 can be selected from various shapes.

In accordance with the electrical connection structure 1 according to the embodiment configured as in the above, when the mating connector 4 is fitted to the connector 3 in the normal fitting state, the inspecting member 312 short-circuits with the electrically conductive member 311 via the short-circuiting member 41 by the mating engaging portion 41*a* of the short-circuiting member 41 being engaged with the engaging portion 311*a* of the connector 3 and being in contact with the contact part 312*a* of the inspecting member 312, and the short-circuiting member 41 being in contact with the electrically conductive member 311. In other words, engaging between the mating engaging portion 41*a* and the engaging portion 311*a* and contacting between the mating engaging portion 41*a* and the contact part 312*a* occur at the same time. Therefore, in the half-fitting state in which the mating engaging portion 41*a* of the short-circuiting member 41 of the mating connector 4 is not engaged with the engaging portion 311*a* of the connector 3, the mating engaging portion 41*a* is not in contact with the contact part 312*a* of the inspecting member 312. Thus, an erroneous detection result being produced, which erroneous detection result is that the short-circuiting member 41 and the inspecting member 312 are short-circuited and the mating connector 4 is in the normal fitting state despite it being in the half-fitting state in which the mating engaging portion 41*a* is not engaged with the connector 3, is suppressed. Thus, the electrical connection structure 1 that can reliably detect the half-fitting state can be provided.

Due to the increasing/decreasing number of contacts 3*c* of the connector 3, the length of the connector 3 in the width direction (second direction) D2 can change. Even in such a case, when the inspecting member 312 is connected to the base member 2 by extending along the fitting/separating direction, not extending along the width direction D2, the inspecting member 312 can be shared without being influenced by the change in length of the connector 3 in the width direction D2. On the other hand, in the connector of Japanese Patent Application Publication No. 2019-040746, the inspecting member is provided so as to straddle the connector in the width direction. Thus, with the connector of Japanese Patent Application Publication No. 2019-040746, every time the length of the connector in the width direction changes due to an increase/decrease in the number of contacts of the connector, an inspecting member having a length corresponding to that thereof needs to be provided, so that it is difficult to achieve sharing of the inspecting member.

According to the embodiment, the short-circuiting member 41 of the mating connector 4 is formed with an electrically conductive member, or, specifically a metal plate, so that, even if it is downsized or slimmed, it can have a sufficient strength in comparison to a case in which it is formed with a resin material, for example. In this case, for the mating engaging portion 41*a* provided in the short-circuiting member 41 as well, a sufficient locking function can be demonstrated even when the mating engaging portion 41*a* is downsized or slimmed. Moreover, in this case, even when the mating engaging portion 41*a* is downsized or slimmed, a sufficient audible click sound can be generated when the mating engaging portion 41*a* and the engaging portion 311*a* are engaged, so that the connector 3 and the mating connector 4 being fitted in the half-fitting state is suppressed.

According to the embodiment, the electrically conductive member 311 is provided so as to be positioned on the inner surface of the housing 30 of the connector 3 such that it makes up at least a part of the fitting portion 32 to be fitted to the mating connector 4. In this case, when the connector 3 and the mating connector 4 are fitted to each other, between the mating connector 4 and the electrically conductive member 311, no other member is interposed. Thus, misalignment of the electrically conductive member 311 with respect to the fitting portion 32, which misalignment is due to a dimensional error of a different member, is suppressed, and, consequently, it is made possible to detect the half-fitting state by the half-fitting detecting portion 31 with high accuracy.

According to the embodiment, in the normal fitting state, the contact portion of the contact part 312*a* and the mating engaging portion 41*a* and the contact portion of the electrically conductive member 311 and the short-circuiting member 41 are lined up at a distance along the fitting/separating direction D1. In this case, the direction of short-circuiting of the half-fitting detecting portion 31 and the short-circuiting member 41 and the fitting/separating direction D1 of the connector 3 and the mating connector 4 match each other, making it easy to design a short-circuiting form of the half-fitting detecting portion 31 and the short-circuiting member 41 in accordance with the fitting form of the connector 3 and the mating connector 4.

According to the embodiment, the short-circuiting member 41 of the mating connector 4 is a cantilevered elastic member extending in the fitting/separating direction D1, while the mating engaging portion 41*a* is in sliding contact with the electrically conductive member 311 on the separating direction D12 with respect to the through hole 311*b* by the short-circuiting member 41 being pressed against the electrically conductive member 311 to be elastically deformed when the mating connector 4 moves in the fitting direction D11 to be fitted to the connector 3. Moreover, the mating engaging portion 41*a* is in contact with the contact part 312*a* by the short-circuiting member 41 being elastically restored such that the mating engaging portion 41*a* is positioned in the through hole 311*b* when the mating connector 4 is fitted to the connector 3 in the normal fitting state. In this way, providing the through hole 311*b* in the electrically conductive member 311 and configuring the short-circuiting member 41 to be the cantilevered elastic member make it possible to provide a detecting function and an engaging function in a simple structure.

1 Electrical connection structure
10 Half-fitting detecting mechanism
2 Base member
2*a* Surface
21 Connecting portion for mounting
22 Connecting portion for inspecting
2*c* Connecting portion for terminal
2*w* Wiring
3 Connector
30 Housing
301 First wall portion
302 Second wall portion
303 Third wall portion
304 Fourth wall portion
305 Opposing wall portion
31 Half-fitting detecting portion
311 Electrically conductive member
311*a* Engaging portion
311*b* Through hole
311*c* Abutting portion
312 Inspecting member
312*a* Contact part
32 Fitting portion
32*a* Guide portion
32*h* Housing space
3*c* Contact
4 Mating connector
40 Mating housing
401 First mating wall portion
402 Second mating wall portion
403 Third mating wall portion
404 Fourth mating wall portion
405 Mating opposing wall portion
41 Short-circuiting member
41*a* Mating engaging portion
41*b* Operating portion
41*c* Short-circuiting portion
42 Mating fitting portion
42*a* Mating guide portion
4*c* Mating contact
D1 Fitting/separating direction
D11 Fitting direction
D12 Separating direction
D2 Second direction
D3 Third direction
W Electrical wire

The invention claimed is:

1. An electrical connection structure comprising:

a base member; a connector being mounted to the base member to be electrically connected thereto; and a mating connector to be fitted/separated in a fitting/separating direction with respect to the connector and to be electrically connected to the connector by being fitted thereto;

wherein the electrical connection structure comprises a half-fitting detecting mechanism to detect whether the mating connector is fitted in a normal fitting state;

the half-fitting detecting mechanism includes: a half-fitting detecting portion being provided in the connector; and a short-circuiting member being electrically conductive and provided in the mating connector, wherein the half-fitting detecting portion includes:

an electrically conductive member being electrically connected to the base member to be in contact with the short-circuiting member of the mating connector to electrically connect the short-circuiting member and the base member; and an inspecting member being electrically conductive, having a contact part to be in contact with the short-circuiting member, and being provided in a non-contact state with respect to the electrically conductive member;

wherein the half-fitting detecting portion allows a half-fitting state to be detected by the short-circuiting member being in non-contact with the inspecting member when the mating connector is fitted to the connector in the half-fitting state, wherein the electrically conductive member has an engaging portion to engage with a mating engaging portion of the short-circuiting member to suppress separating of the mating connector, and wherein the inspecting member short-circuits with the electrically conductive member via the short-circuiting member by the mating engaging portion being engaged with the engaging portion and being in contact with the contact part and the short-circuiting member being in contact with the electrically conductive member when the mating connector is fitted to the connector in the normal fitting state.

2. The electrical connection structure according to claim 1, wherein the electrically conductive member makes up at least a part of a fitting portion to be fitted to the mating connector.

3. The electrical connection structure according to claim 1, wherein a contact portion of the contact part and the mating engaging portion and a contact portion of the electrically conductive member and the short-circuiting member are lined up at a distance along the fitting/separating direction when they are in the normal fitting state.

4. The electrical connection structure according to claim 1, wherein the inspecting member extends along the fitting/separating direction, and an end on the fitting direction side of the inspecting member is electrically connected to the base member.

5. The electrical connection structure according to claim 4, wherein the contact part is provided at an edge on the separating direction side of the inspecting member, wherein the electrically conductive member has:

a through hole being provided so as to be positioned on an inner surface of a housing of the connector and being provided in correspondence with the contact part; and an abutting portion to abut on the short-circuiting member, on at least one of the fitting direction side and the separating direction side with respect to the through hole, wherein the short-circuiting member is a cantilevered elastic member extending in the fitting/separating direction, wherein the short-circuiting member has a short-circuiting portion on at least one of the fitting direction side and the separating direction side with respect to the mating engaging portion, which short-circuiting portion is to abut on the abutting portion in the normal fitting state, wherein the mating engaging portion is in sliding contact with the electrically conductive member on the separating direction side with respect, to the through hole by the short-circuiting member being pressed against the electrically conductive member to be elastically deformed when the mating connector moves in the fitting direction to be fitted to the connector, and the inspecting member short-circuits with the electrically conductive member via the short-circuiting member by the mating engaging portion being elastically restored so as to be positioned in the through hole to be in contact with the contact part and the short-circuiting portion being in contact with the abutting portion when the mating connector is fitted to the connector in an normal fitting state.

* * * * *